US006563055B1

(12) United States Patent
Burdick

(10) Patent No.: US 6,563,055 B1
(45) Date of Patent: May 13, 2003

(54) ELECTRIC FENCE INSULATOR

(75) Inventor: Brett R. Burdick, Knoxville, TN (US)

(73) Assignee: Fi-Shock, Inc., Knoxville, TN (US)

( * ) Notice: Subject to any disclaimer, the term of this patent is extended or adjusted under 35 U.S.C. 154(b) by 0 days.

(21) Appl. No.: 10/085,162

(22) Filed: Feb. 27, 2002

(51) Int. Cl.[7] ..... H01B 17/38

(52) U.S. Cl. ..... 174/158 F; 174/138 G; 174/154; 174/158 R; 174/161 R; 174/161 F; 174/163 R; 174/163 F; 174/168; 174/188

(58) Field of Search ..... 174/138 G, 154, 174/158 R, 161 R, 161 F, 163 R, 163 F, 158 F, 168, 188

(56) References Cited

U.S. PATENT DOCUMENTS

| | | | | |
|---|---|---|---|---|
| 2,756,969 A | | 7/1956 | Meinen | |
| 3,562,407 A | | 2/1971 | Beebe | |
| 4,049,905 A | | 9/1977 | Maranell | |
| 4,077,611 A | | 3/1978 | Wilson | |
| 4,202,378 A | | 5/1980 | Bush et al. | |
| 4,520,231 A | | 5/1985 | Hubbell | |
| 4,623,756 A | | 11/1986 | Wilson, Jr. | |
| 4,680,428 A | | 7/1987 | Wilson, Jr. | |
| 4,833,850 A | | 5/1989 | Lunn | |
| 4,853,492 A | | 8/1989 | Hussey | |
| 5,085,409 A | | 2/1992 | Teixeira | |
| 5,313,757 A | | 5/1994 | Schnepf | |
| 5,568,708 A | | 10/1996 | Kassardjian et al. | |
| 5,729,941 A | * | 3/1998 | Kassardjian et al. | 248/523 |
| 5,731,895 A | | 3/1998 | Owczarzak et al. | |
| 5,943,836 A | | 8/1999 | Kassardjian | |
| 5,946,871 A | | 9/1999 | Kassardjian et al. | |

* cited by examiner

*Primary Examiner*—Dean A. Reichard
*Assistant Examiner*—Jinhee J Lee
(74) *Attorney, Agent, or Firm*—Luedeka, Neely & Graham PC

(57) ABSTRACT

An insulator for an electric fence of the type having posts, electric wire, and insulators mounted on the posts for supporting the wire, the insulator including a body portion having a closed end opposite an open end to define a blind bore having a substantially continuous sidewall; a support extending from the body for supporting the wire, and a plurality of ribs radially disposed within the blind bore and extending away from the sidewall toward a central portion of the bore.

6 Claims, 6 Drawing Sheets

ELECTRIC FENCE INSULATOR

FIELD OF THE INVENTION

This invention relates generally to insulators for electric fences. More particularly, this invention relates to insulators mountable on a post for supporting conductors of an electric fence.

BACKGROUND AND SUMMARY OF THE INVENTION

Electric fences typically include posts, electric wire, and insulators mounted on the posts for supporting the wire. Improvements are needed in the construction of insulators.

The invention relates to an insulator for an electric fence of the type having posts, electric wire, and insulators mounted on the posts.

In a preferred embodiment, the insulator includes a body portion having a closed end opposite an open end to define a blind bore having a substantially continuous sidewall; a support extending from the body for supporting the wire, and a plurality of ribs radially disposed within the blind bore and extending away from the sidewall toward a central portion of the bore.

Each rib preferably has an angled profile defined by a first sector and a second sector, with the first sector located nearer the open end of the bore than the second sector. The first sector has a first post contact edge disposed at a first angle relative to a plane perpendicular to a centerline of the blind bore. The second sector has a second post contact edge disposed at a second angle relative to a plane perpendicular the centerline of the blind bore. The first angle is preferably greater than the second angle.

The invention advantageously provides an insulator that is readily and securely mountable to a round support post and which covers the exposed end of the support post.

BRIEF DESCRIPTION OF THE DRAWINGS

Further features of preferred embodiments of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
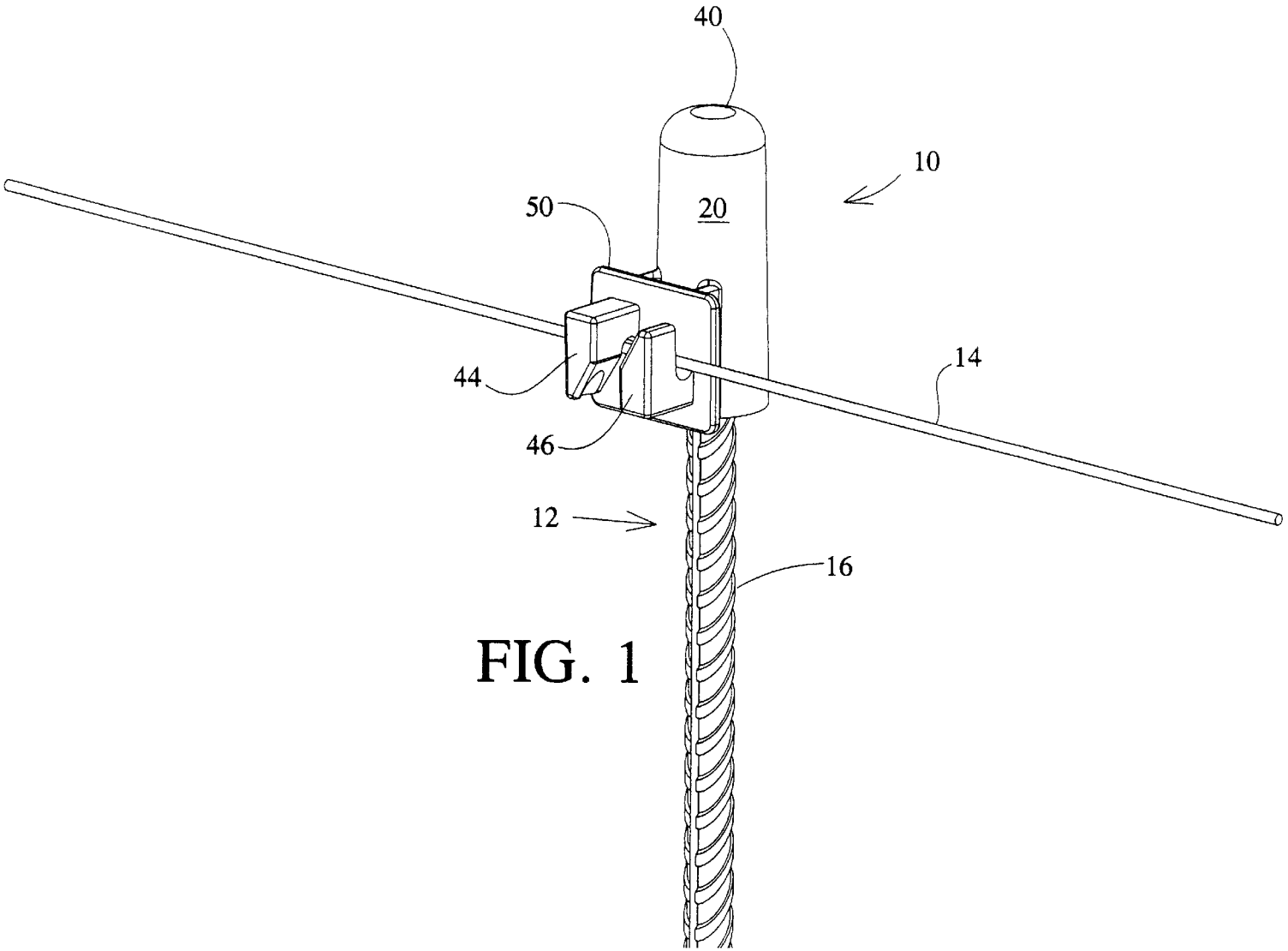
FIG. 1 is a front perspective view of an insulator in accordance with a preferred embodiment of the invention installed on a post and supporting a wire.

With initial reference to FIG. 1, the invention relates to an insulator 10 for an electric fence. The insulator 10 is mountable on a support post 12 for supporting a wire 14 to which an electrical current is applied. The post 12 is preferably reinforcing bar, i.e., a round steel member having a plurality of serrations 16. It will be understood that the post may me of any rigid material, such as wood, metal, and plastic.

Figure 3:
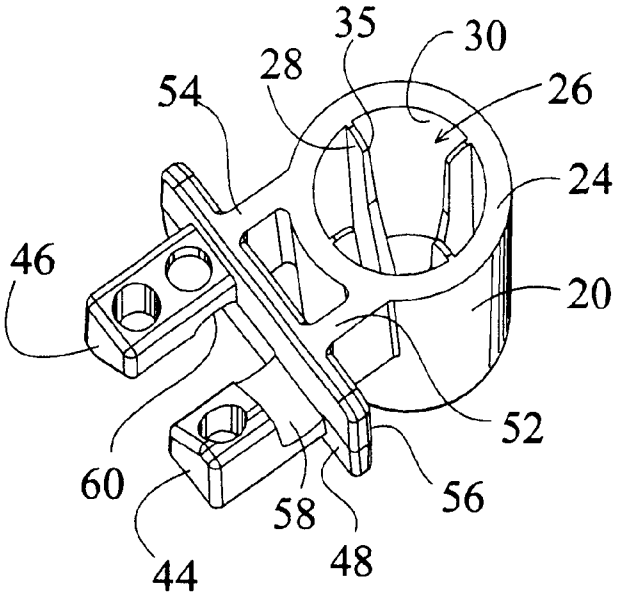
FIG. 3 is a bottom perspective view of the insulator of FIG. 2.
Figure 2:
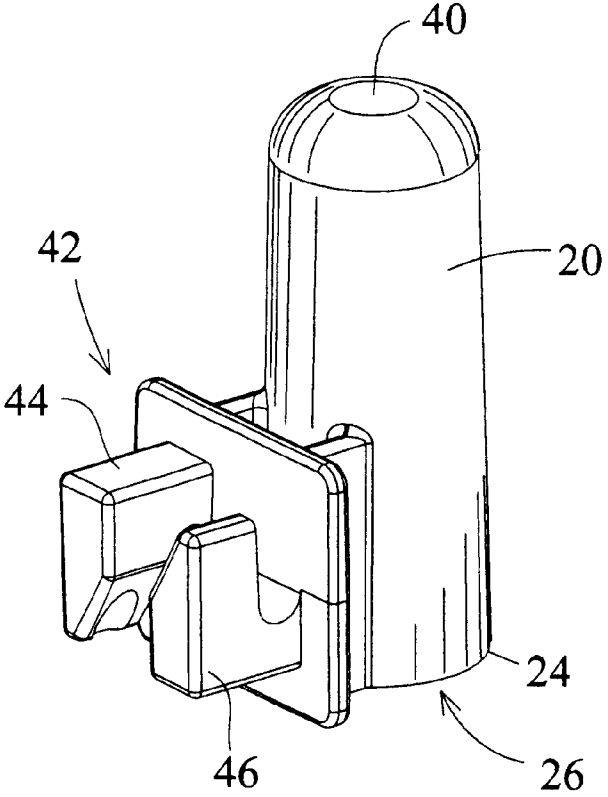
FIG. 2 is a front perspective view of the insulator of FIG. 1.
Figure 4:
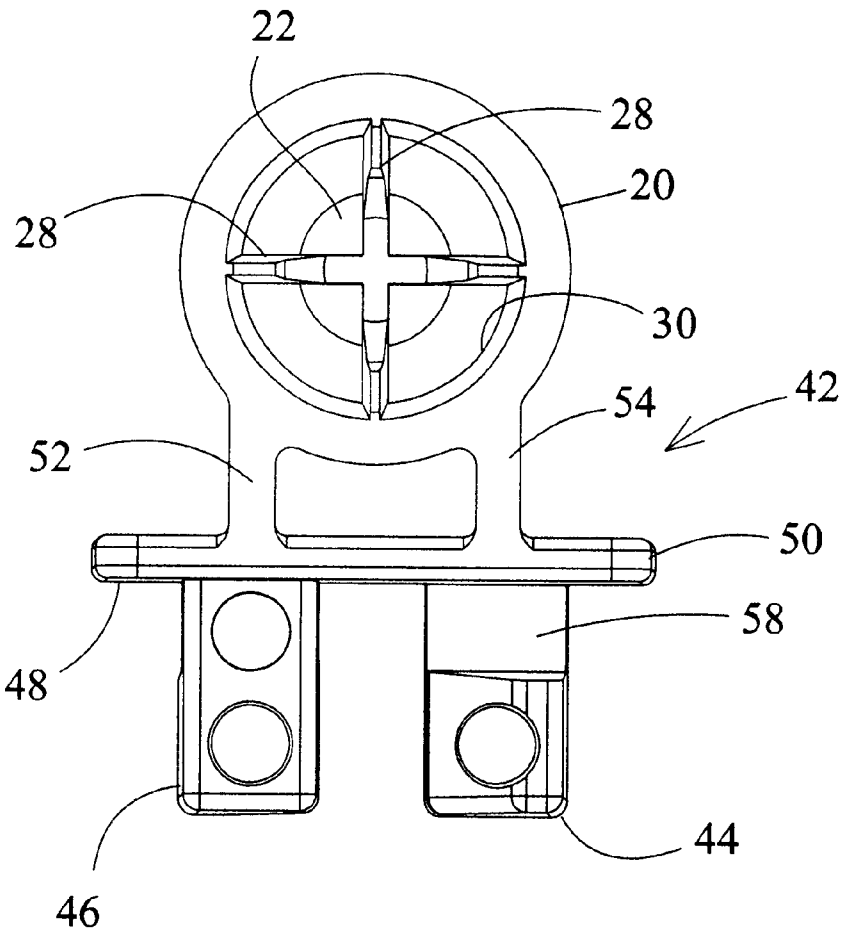
FIG. 4 is a bottom plan view of the insulator of FIG. 2.
Figure 6:
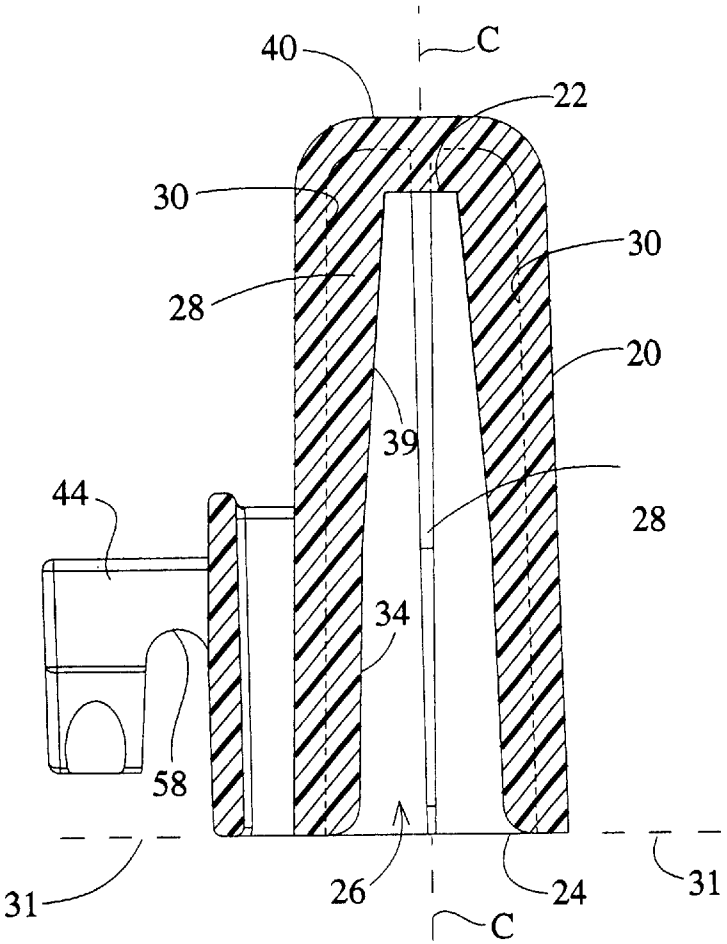
FIG. 6 is a cross-sectional side view taken along line 6—6 of FIG. 5.
Figure 5:
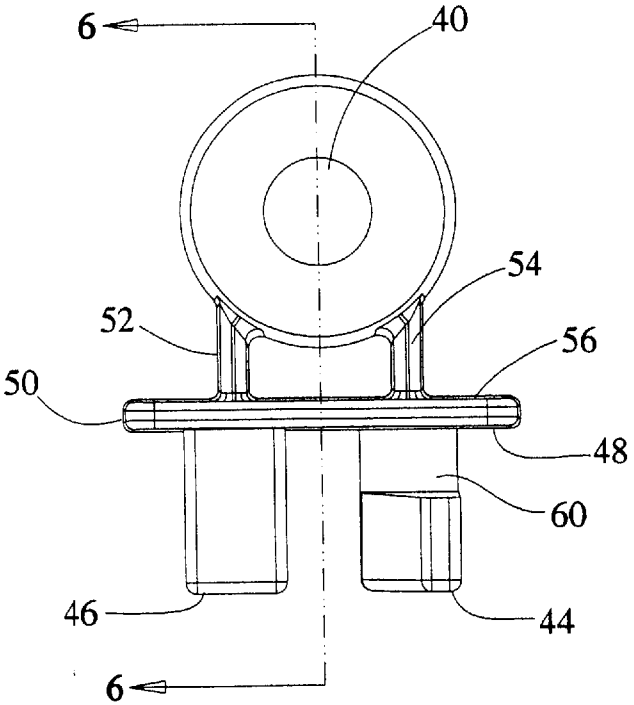
FIG. 5 is a top plan view of the insulator of FIG. 2.
Figure 7:
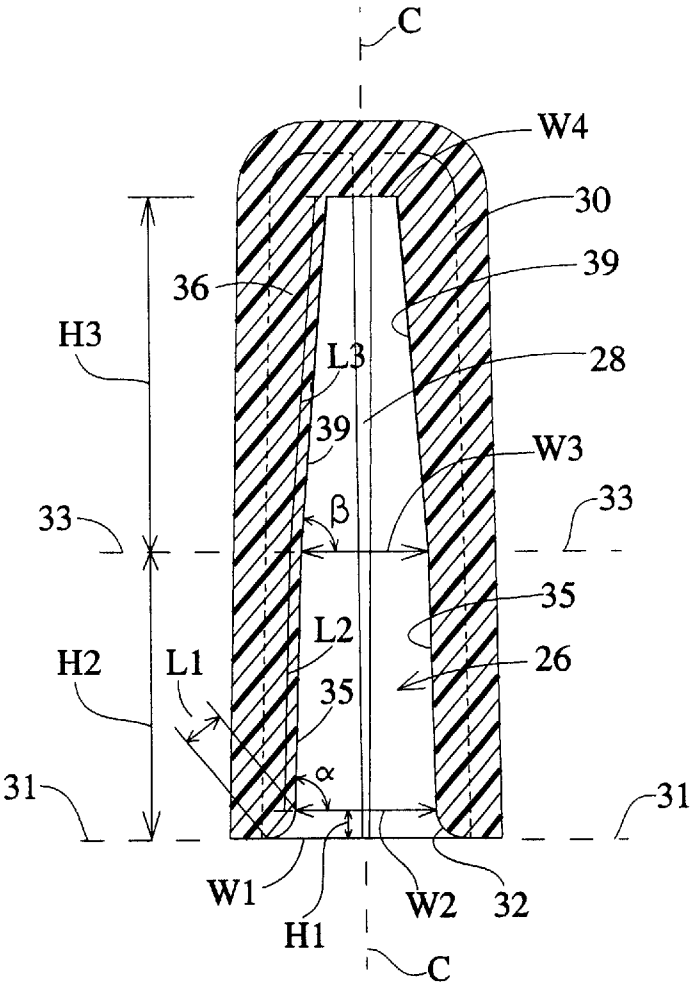
FIG. 7 is a cross-sectional view of the insulator of FIG. 2 showing preferred dimensions.

With additional reference to FIGS. 2–6, the insulator 10 is preferably of one-piece molded plastic construction and includes a body 20 having a closed end 22 opposite an open end 24 to define a blind bore 26 (FIG. 6). The bore 26 is preferably substantially cylindrical and includes a plurality of ribs 28, preferably four ribs, disposed radially in the open area of the bore 26 toward the center of the bore 26 and connected to an inner sidewall 30 of the bore 26 (FIGS. 3, 4 and 6). For example, while the insulator 10 is shown in a preferred embodiment with four ribs, it will be understood that other even or odd numbers of ribs may be used, such as 2, 3, 5, 6 or more.

The body 20 preferably has a substantially cylindrical external shape, however, it will be understood that the external configuration of the body 20 may be rectangular or of other geometry.

The ribs 28 are preferably substantially uniformly spaced apart from one another and configured for receiving and frictionally retaining the steel post 12. Each rib 28 preferably has a plurality of sectors having different slopes relative to planes 31 and 33 that are perpendicular to a centerline C of the bore 26. For example, rib 28 preferably has sectors 32, 34 and 36, with sector 34 having a post contacting edge 35 and sector 36 having a post contacting edge 39. The edges 35 and 39 are positioned so that at least a portion of the edge 35 or the edge 39 or both are available for bearing against the post 12, depending upon the diameter of the post, when the insulator 10 is installed on the post 12.

The insulator 10 preferably has the following preferred dimensions for use with posts having a diameter of from about 5/16 to about 13/32 inches.:

| Dimension | Degrees | Distance (in) |
|---|---|---|
| α (angle of Sector 34) | 88.5 | — |
| β (angle of Sector 36) | 85.5 | — |
| W1 (opening width of bore 26) | — | 0.73 |
| W2 (Opening width of bore at beginning of Sector 34) | — | 0.50 |
| W3 (Opening width of bore at beginning of Sector 36) | — | 0.45 |
| W4 (end width of Sector 36) | | 0.25 |
| H1 (height of Sector 32) | — | 0.10 |
| H2 (height of Sector 34) | — | 0.90 |
| H3 (height of Sector 36) | — | 1.24 |
| L1 (length of Sector 32) | — | 0.14 |
| L2 (length of Sector 34) | — | 0.93 |
| L3 (length of Sector 36) | — | 1.24 |

The configuration of the sector 32 facilitates placement of the insulator 10 onto the post 12. The angled profile of the sectors 34 and 36 facilitates frictional retention of the insulator 10 on the post 12 and enables the insulator 10 to accommodate a relatively wide range of post diameters. Accordingly, it is preferred that the angle a be greater than the angle β.

The insulator 10 may be installed onto the post 12 by placing the open end 24 of the bore 26 onto the top of the post 12 and pressing or otherwise urging the insulator 10 downwardly, as by hammering, so that the post 12 is urged toward the end 22. The ribs 28 tend to deform and compress against the post 12 to provide a friction fit of the insulator 10 onto the post 12. Top portion 40 of the insulator 10 is preferably rounded so as to provide a relatively smooth surface. As will be appreciated, the top portion 40 of the insulator provides a protective cap over the top of the post.

An electric fence may be constructed by setting a plurality of the posts 12 in the ground, positioning one of the insulators 10 over each post 12, stringing the wire 14 so that it is supported by each of the insulators 10, and connecting the wire 14 to a source of electricity. Each insulator 10 preferably includes a wire support 42 for supporting the wire 14.

The support 42 preferably includes a pair of lugs 44 and 46 projecting outwardly from an outer surface 48 of a plate 50. A pair of legs 52 and 54 extend between an exterior portion of the body 20 and an inner surface 56 of the plate 50. The lugs 44 and 46 may be configured to extend directly from the body 20, however, the preferred construction utilizing the plate enables the lugs 44 and 46 to be advantageously positioned further from the body 20 and further apart from one another, thereby offering improved strength characteristics. The lug 44 has a downwardly facing recess 58 and the lug 44 has an upwardly facing recess 60. The recesses 58 and 60 are configured for engaging and retaining the wire 14 in a strung orientation.

Figure 8:
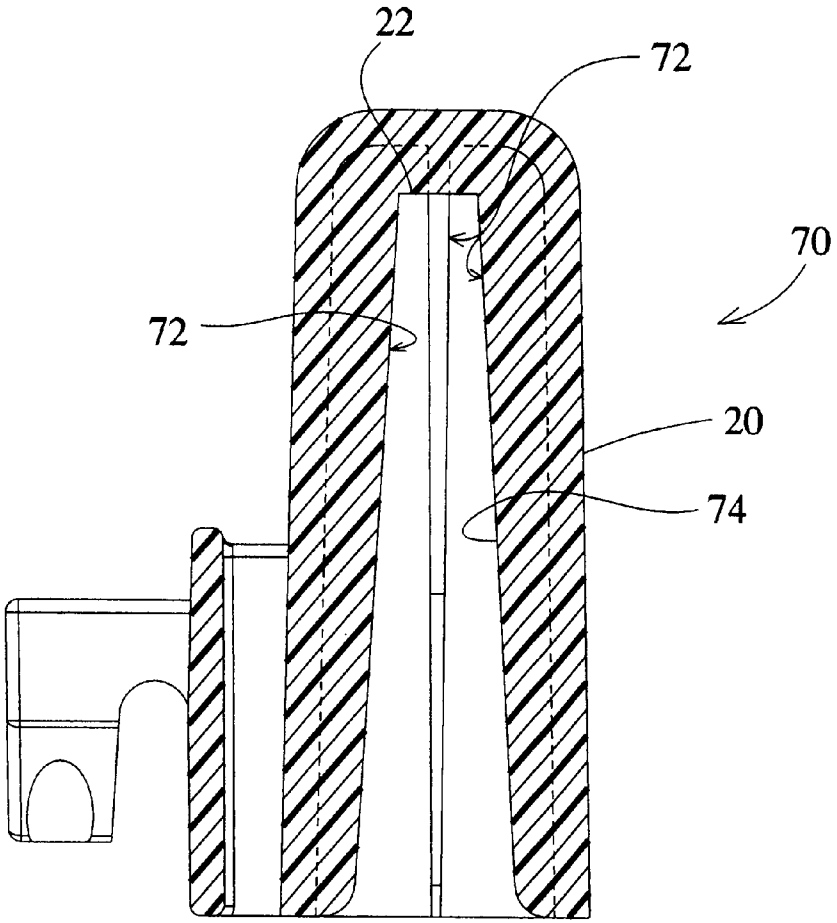
FIG. 8 is a cross-sectional side view of an insulator in accordance with an alternative embodiment.

With reference now to FIG. 8, there is shown an alternate embodiment of an insulator 70 for an electric fence. The insulator 70 is substantially identical to the insulator 10, except it includes a plurality of ribs 72 which differ from the ribs 28. The ribs 72 are preferably substantially uniformly spaced apart from one another and configured for receiving and frictionally retaining the steel post 12. Each rib 72 preferably includes a post contacting edge 74 having a substantially constant slope relative to a plane perpendicular to a centerline C of the bore 26, with each edge having a substantially similar slope.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. An insulator for an electric fence of the type having posts, electric wire, and insulators mounted on the posts for supporting the wire, the insulator comprising a body portion having a closed end opposite an open end to define a blind bore having a substantially continuous sidewall; a support extending from the body for supporting the wire, and a plurality of ribs radially disposed within the blind bore and extending away from the sidewall toward a central portion of the bore, each rib having an angled profile defined by a first sector having a first post contact edge disposed at a first angle relative to a plane perpendicular to a centerline of the blind bore and a second sector having a second post contact edge disposed at a second angle relative to a plane perpendicular to the centerline of the blind bore, with the first sector being located nearer the open end of the blind bore than the second sector and the first angle being different than the second angle, and the first and the second angles each being less than 90 degrees to enable the insulator to be mounted on a range of post diameters.

2. The insulator of claim 1, wherein the ribs are substantially uniformly spaced apart from one another.

3. The insulator of claim 1, wherein the plurality of ribs comprises four ribs.

4. The insulator of claim 1, wherein the first angle is greater than the second angle.

5. The insulator of claim 1, further comprising a third sector positioned between the open end of the blind bore and the first sector.

6. The insulator of claim 1, wherein the first and second post contact edges each have a length and the length of the second post contact edge is greater than the length of the first post contact edge.

* * * * *